US008899162B2

(12) United States Patent
Chikkakalbalu

(10) Patent No.: US 8,899,162 B2
(45) Date of Patent: Dec. 2, 2014

(54) UNITIZED SHELVING

(75) Inventor: Chandrashekhara Chikkakalbalu, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 326 days.

(21) Appl. No.: 13/328,456

(22) Filed: Dec. 16, 2011

(65) Prior Publication Data

US 2012/0292277 A1 Nov. 22, 2012

Related U.S. Application Data

(60) Provisional application No. 61/488,286, filed on May 20, 2011.

(51) Int. Cl.

| | |
|---|---|
| ***A47B 96/02*** | (2006.01) |
| ***A47F 5/08*** | (2006.01) |
| *A47F 3/06* | (2006.01) |
| *A47F 5/10* | (2006.01) |
| *A47B 57/42* | (2006.01) |

(52) U.S. Cl.

CPC ..... *A47B 96/027* (2013.01); *A47B 96/021* (2013.01); *A47B 96/028* (2013.01); *A47F 3/06* (2013.01); *A47F 5/101* (2013.01); *A47B 57/42* (2013.01)

USPC ..... 108/108

(58) Field of Classification Search

CPC .... A47F 5/103; A47B 57/045; A47B 96/027; A47B 96/028; A47B 57/42; A47B 57/52; A47B 96/061; A47B 47/024; A47B 96/067

USPC ..... 108/106–108; 211/103, 193, 192, 191, 211/187; 312/351, 408; 248/235, 250, 241, 248/243, 245

See application file for complete search history.

(56) References Cited

U.S. PATENT DOCUMENTS

| | | | | | |
|---|---|---|---|---|---|
| 2,790,559 | A * | 4/1957 | Stephenson et al. | ..... | 108/108 |
| 3,082,880 | A * | 3/1963 | Mapson | ..... | 108/32 |
| 3,088,424 | A * | 5/1963 | Knuth | ..... | 108/108 |
| 3,130,693 | A * | 4/1964 | Shell | ..... | 108/108 |
| 3,469,543 | A * | 9/1969 | Everett | ..... | 108/147.17 |
| 3,511,193 | A * | 5/1970 | Schild | ..... | 108/152 |
| 3,556,306 | A * | 1/1971 | Shell | ..... | 211/90.02 |
| 4,139,247 | A * | 2/1979 | Karashima | ..... | 312/130 |
| 4,344,367 | A * | 8/1982 | Merl | ..... | 108/1 |
| 5,022,541 | A * | 6/1991 | White | ..... | 211/186 |
| 5,205,421 | A * | 4/1993 | Bustos | ..... | 211/59.2 |
| 5,452,812 | A * | 9/1995 | Niequist et al. | ..... | 211/187 |
| 5,577,623 | A * | 11/1996 | Bustos | ..... | 211/187 |
| 5,921,411 | A * | 7/1999 | Merl | ..... | 211/90.01 |
| 6,189,707 | B1 * | 2/2001 | Meyers et al. | ..... | 211/90.04 |
| 6,520,353 | B2 * | 2/2003 | Fulbright | ..... | 211/153 |
| 7,918,516 | B2 * | 4/2011 | Decker et al. | ..... | 312/116 |

* cited by examiner

*Primary Examiner* — Janet M Wilkens

(74) *Attorney, Agent, or Firm* — Sutherland Asbill & Brennan LLP

(57) ABSTRACT

The shelf assembly comprises a shelf having top and bottom surfaces. The shelf includes at least one support rail that is secured to the bottom surface of the shelf and runs parallel to one side of said shelf. The support rail also has a tab slot, which is located in a side and adjacent to an end thereof. The shelf assembly also comprises a shelf bracket having a lip and a skirt that extends perpendicular from said lip. The lip and the skirt extend along a length of the shelf bracket, and the shelf bracket has a first tab, which is located in the lip and configured to be removably received in the tab slot. The shelf bracket also has anchoring tabs that are located on an end thereof and configured to be received in a shelving support frame.

20 Claims, 6 Drawing Sheets

UNITIZED SHELVING

CROSS-REFERENCE TO RELATED APPLICATION

This Application claims the benefit of U.S. Provisional Application Ser. No. 61/488,286 filed on May 20, 2011, entitled "UNITIZED SHELVING," commonly assigned with the present invention and incorporated herein by reference.

TECHNICAL FIELD

This application is directed, in general, to a shelving system and, more specifically, to a shelving system comprising a shelf assembly.

BACKGROUND

Shelving systems are extensively used in commercial retail stores and are used to display various items and merchandises and also in storing those same items. Shelving systems take various shapes and forms and some of them are cased and/or covered, and some are used in refrigerated display cases. Conventional shelving systems use a plurality of shelf assemblies, each of which is generally made of three parts. A pair of shelf brackets is connected at opposing sides of a shelf and a pair of connecting rails is secured between the shelf and the shelf brackets to reinforce the connections. These shelf assemblies are generally permanently assembled.

One way of permanently assembling a shelf assembly is assembling by welding and/or spot-welding. Welding and/or spot-welding is not an easy way to assemble a shelf, as it requires proper tools and equipment. Also the resulting shelf assemblies have limited serviceability as individual parts are not replaceable. Moreover, because they must be assembled before used in the field, they present difficulties in transporting. Another way of permanently assembling shelf assemblies is assembling by double-sided structural tapes. While this way of assembling a shelf is easier than welding, it still presents difficulties, especially for those assembled in the field. Also, tapes' effectiveness are vulnerable to changes in the environment such as temperature and humidity and may even present sanitization problems in some applications. One alternative method to the above mentioned assembly methods is to use fasteners. However, similar to those methods noted above, this method presents assembling difficulties in that it requires proper tools and equipment, and an extended assembly time.

SUMMARY

One aspect provides an embodiment of a shelf assembly. The shelf assembly comprises a shelf having top and bottom surfaces. The shelf includes at least one support rail that is secured to the bottom surface of the shelf and runs parallel to one side of the shelf. The support rail also has a tab slot, which is located in a side and adjacent to an end thereof. The shelf assembly also comprises a shelf bracket having a lip and a skirt that extends perpendicular from the lip. The lip and the skirt extend along a length of the shelf bracket, and the shelf bracket has a first tab, which is located in the lip and configured to be removably received in the tab slot. The shelf bracket also has anchoring tabs that are located on an end thereof and configured to be received in a shelving support frame.

Another aspect provides an embodiment of a shelf bracket. The shelf bracket comprises a lip and a skirt that extends perpendicular from the lip. The lip and the skirt extend along a length of the shelf bracket, and the shelf bracket has a first tab that is located on the lip and configured to be removably received in a tab slot in a side and adjacent to an end of at least one support rail that is secured to a bottom surface of a shelf. The shelf bracket has anchoring tabs that are located on an end thereof and configured to be received in a shelving support frame.

Another aspect provides a shelf. The shelf comprises a top surface and a bottom surface. At least one support rail is secured to the bottom surface of the shelf and runs parallel to one side of the shelf. The support rail has a tab slot located in a side thereof and adjacent to an end thereof, and the tab slot is configured to removably receive a first tab located in a lip of a shelf bracket. The lip and a skirt of the shelf bracket extends along a length of the shelf bracket and the shelf bracket has anchoring tabs located on an end thereof and configured to be received in a shelving support frame.

BRIEF DESCRIPTION

Reference is now made to the following descriptions taken in conjunction with the accompanying drawings, in which.

DETAILED DESCRIPTION

As stated above, currently available shelving systems comprise shelf assemblies that are assembled by permanently affixing five (5) individual parts together. Accordingly, these assemblies suffer from reduced serviceability and flexibility since replacing an individual part of the assembly or tweaking/making adjustments to the assembly is extremely difficult. Additionally, they also are inefficient in loading capacity per amount of materials used because of the thick gauge requirements for the sheet metals used in making the parts, especially for those used in heavy duty application.

The following embodiments introduce improved shelving systems comprising shelf assemblies that comprise only three (3) parts and may be assembled without using any fasteners, welding or structural tapes. Because the assemblies can easily be disassembled, they do not suffer from the disadvantages mentioned above. Moreover, the assemblies use a lesser amount of materials compared to a 5-part assembly and provide better loading capacity.

Figure 1:
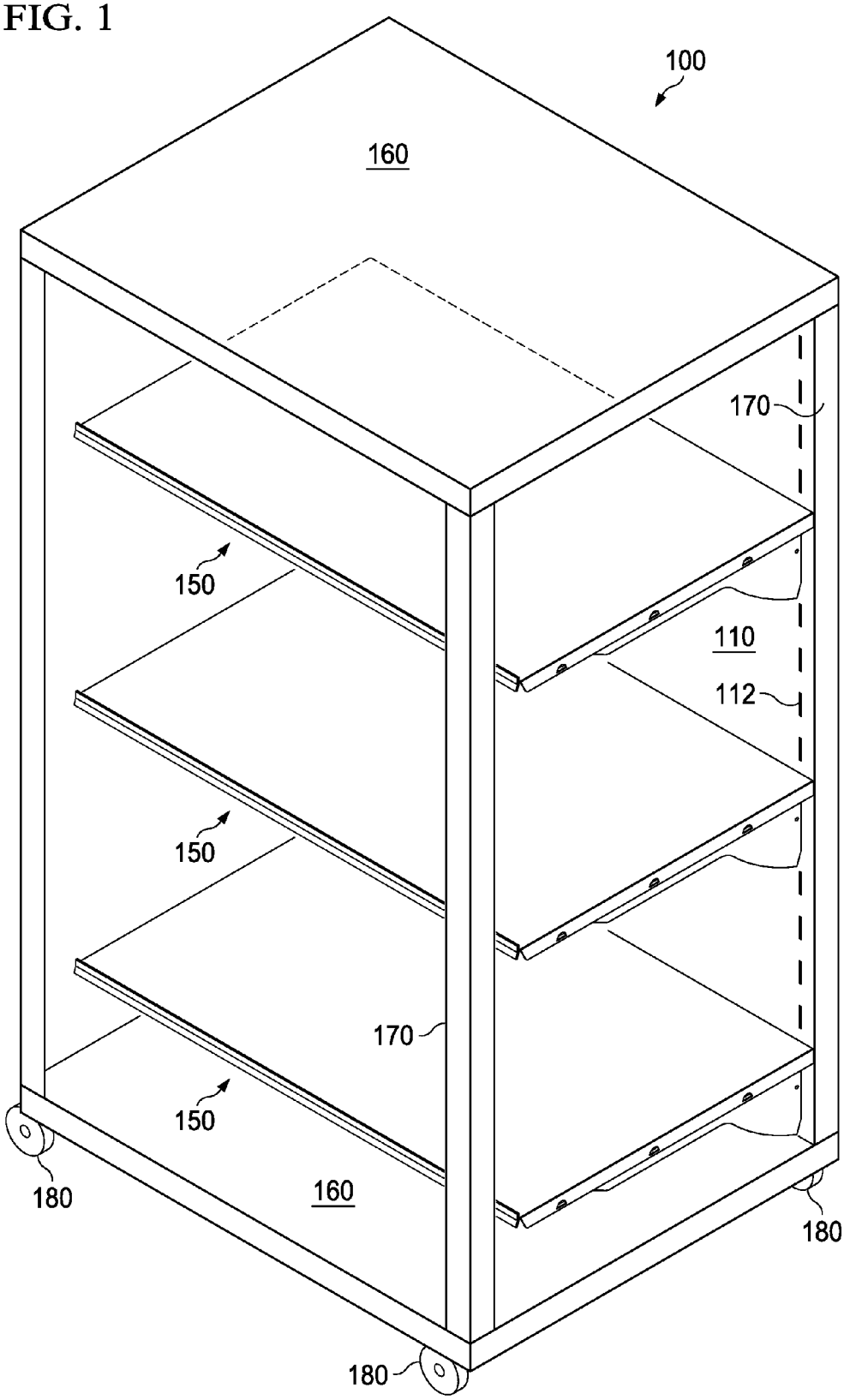
FIG. 1 is an environmental view of an embodiment of a display case.

Referring to FIG. 1, an embodiment of a display case 100 comprising a vertical back-wall 110 that have attachment apertures 112 extending along its length and a plurality of shelf assemblies 150 is shown. Display case 100 may be a temperature-controlled case depending on the items being displayed therein. While the display case 100 has only one column of shelf assemblies 150 in this figure, the display case 100 may comprise multiple columns and each column may include a plurality of shelf assemblies 150 anchored along the column. It is understood that the number of shelf assemblies 150 in a single column is not limited to the number shown in this embodiment. It is also understood that, depending on the applications and the items being displayed, the display case 100 may not have the top and bottom covers 160 and side frames 170 as shown and may be a cabinet. The display case 100 is movable via a plurality of optional rollers 180 at the bottom. Also, depending on the applications, the display case 100 may be affixed to a vertical structure or a wall and be stationary.

Figure 2:
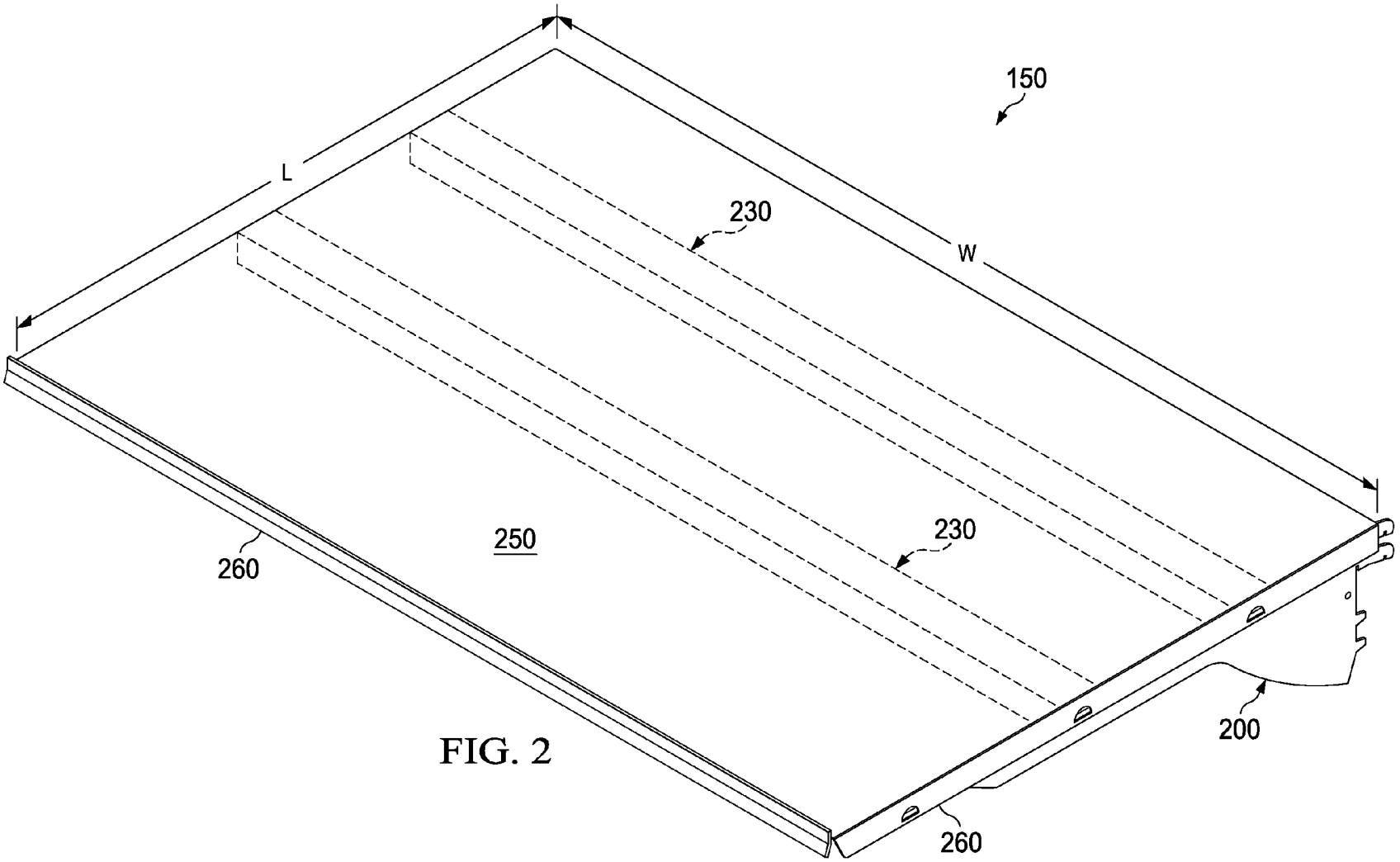
FIG. 2 is an isometric view of an embodiment of a shelf assembly.

Referring to FIG. 2, an embodiment of the shelf assembly 150 in FIG. 1 is shown. In this embodiment, the shelf assembly 150 comprises; a pair of shelf bracket 200, at least one underside support rail 230, (shown in dashed lines) and a shelf 250. Shelf 250 is generally rectangular and has a variable width W and a variable length L, the width being longer than the length L in this embodiment. Shelf 250 has generally flat top and bottom surfaces and has the shelf brackets 200 removably secured along the sides parallel to the length L of the shelf 250. Shelf 250 also has a bracket guide 260 that drops down perpendicularly from the top surface to the bottom surface and extends around the periphery of the shelf 250. Each of the portions of the bracket guide that extend along the length L includes a part that drops further down perpendicularly from the top surface and folds parallel to the top surface. It is understood that the shelf 250 may be in a geometric shape other than rectangular shape and even in a non-geometric shape, and may not comprise the bracket guide 260.

Figure 3:
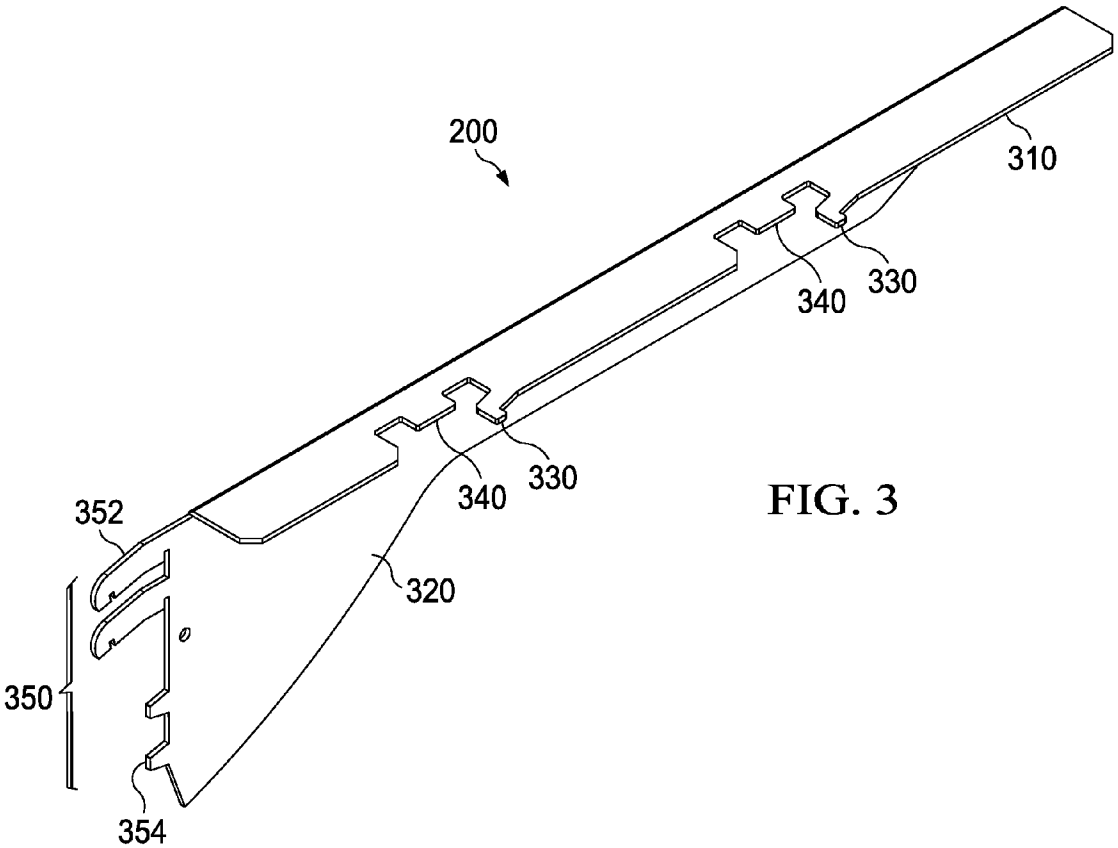
FIG. 3 is an isometric view of an embodiment of shelf bracket.

Referring to FIG. 3, an embodiment of the shelf bracket 200 is shown. Shelf bracket 200 has a lip 310 and a skirt 320 that form a right angle with respect to each other. The lip 310 extends along at least a portion of the length of the shelf bracket 200, and the skirt 320 also extends along at least a portion of the length of the shelf bracket 200. Lip 310 uniquely comprises one or more locking tabs 330 and in certain embodiments, one or more optional second tabs 340. The locking tab 330 and optional second tabs 340 are integrally formed from the lip 310. The locking tab 330, as explained below, is configured to engage a side slot located in one of the above-mentioned support rails 230 to provide a stable and secure support structure for the shelf 250. The optional second tab 340, when present in certain embodiments, is configured to be received within a channel formed in the support rails 230 to provide added stability to the shelf assembly 150. The surface area of the lip 310, which abuts the bottom surface of the shelf 250, may vary with design and supports high stress regions of the shelf assembly 150. It is understood that more support would be provided to the regions, as the surface area of the lip 310 increases.

The skirt 320 further comprises one or more anchoring tabs 350 that extend outwardly from an anchoring end of the shelf bracket 200. Anchoring tab or tabs 350 may include one or more hooking members 352 and one or more position members 354. In certain applications and where added weight is of a concern, more than one of each of the hooking members 352 and position members 354 is highly desirable to provide added stability and weight-bearing strength to the shelf 250. Anchoring tab or tabs 350 are configured to be received within the attachment apertures 112 formed in the vertical back-wall 110 of the display case 100 of FIG. 1. When properly positioned within the attachment apertures 112, the hooking members 352 hook against the periphery of the attachment apertures 112 while the position members 354 stabilize and minimize the movements of the hooking members 352, preventing disengagement of the shelf assembly 150 from the back-wall 110. It is understood that anchoring tabs 350 may include other combinations and/or configurations of hooking and position members as long as they provide adequate anchoring to the shelf assembly 150.

Figure 4:
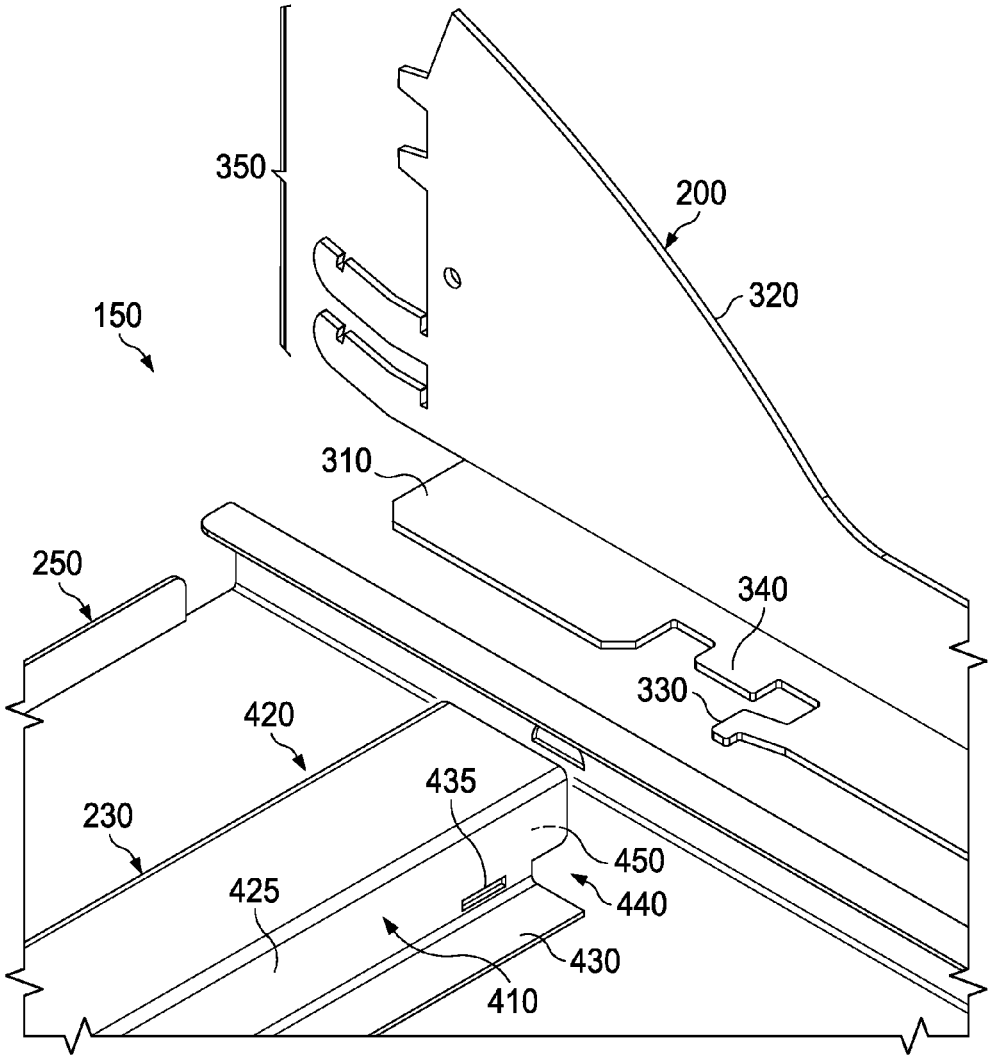
FIG. 4 is a view of the embodiment shown in FIG. 3 and an embodiment of a shelf before their assembly.

FIG. 4 refers to an embodiment of the shelf assembly 150 before assembly. The bottom surface of the shelf 250 has the support rail 230 attached to it. Support rail 230 runs parallel to a side along the width W of the shelf 250 and in the illustrated embodiment, comprises first and second parallel rails 410, 420. Although two rails 410, 420 are shown, it should be understood that in other embodiments, the support rail 230 may have only one such rail. Each of the first and second rails 410, 420, includes a rail side 425 and a flange 430. Rail side 425 forms a right angle with the flange 430, which is secured to the bottom surface of the shelf 250 and provides support to the high stress regions. Rail side 425 comprises a rectangular tab slot 435 adjacent an end thereof and also comprises an overhang that creates a space 440 underneath and between the overhang and the bottom surface of the shelf 250.

First and second rails 410, 420 oppose and run parallel to each other. The space between the first and second rails 410, 420 forms a rectangular channel 450. In this embodiment, the first and second rails 410, 420 are connected to each other by a top section located over the channel 450 to form a "hat rail." It is understood that the first and second rails 410, 420 are not required to be connected and the connection over the channel 450 may be corrugated to provide lateral support to the shelf bracket 200.

Figure 5:
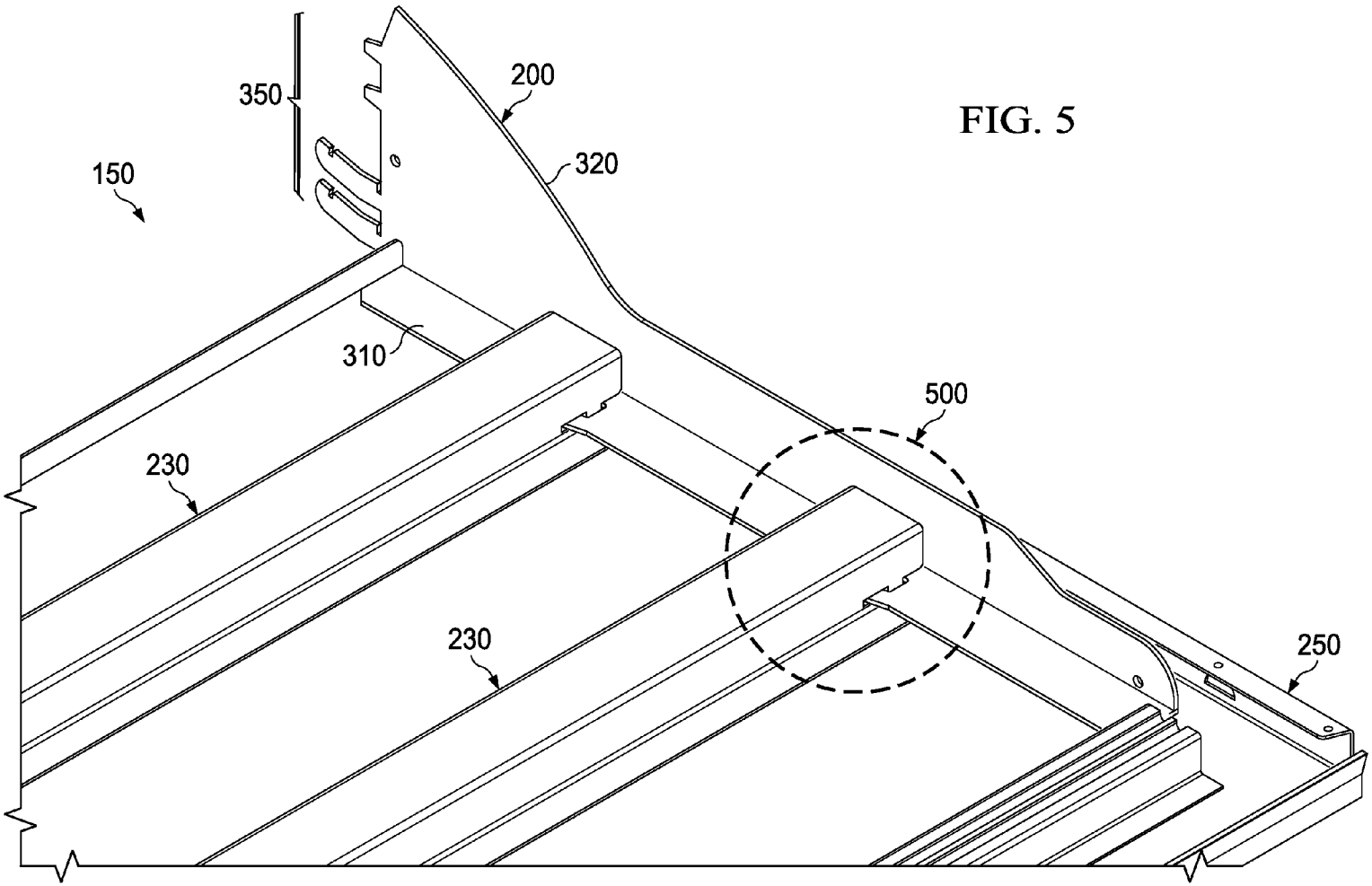
FIG. 5 is a view of the embodiments shown in FIG. 4 after their assembly.

FIG. 5 shows the shelf assembly 150 of FIG. 4 after assembly. As shown in these figures, the shelf assembly 150 comprises a plurality of the support rails 230 that extend across the bottom surface of the shelf 250 and removably receive the shelf bracket 200 at each end. It is understood that the number of the support rails 230 are not limited to the number of the rails shown in this figure and that the shelf assembly 150 may comprise an additional rail that does not receive the shelf bracket 200. Lip 310 of the shelf bracket 250 is received in the space 440 as the locking and the optional second tabs 330, 340 are removably received in the tab slot 435 and the channel 450, respectively, to form a locking profile. It is understood that as the number of the support rails 230 increase, so as the number of the locking profiles and the locking profiles are formed such that portions of the lip 310 overlap portions of the plurality of the support rails 230, adding more support to high stress region in the shelf 250 such that the shelf assembly's 150 loading capacity has been tested to be twice that of a conventional shelf assembly. Circled section 500 is discussed in more details in FIG. 6.

Figure 6:
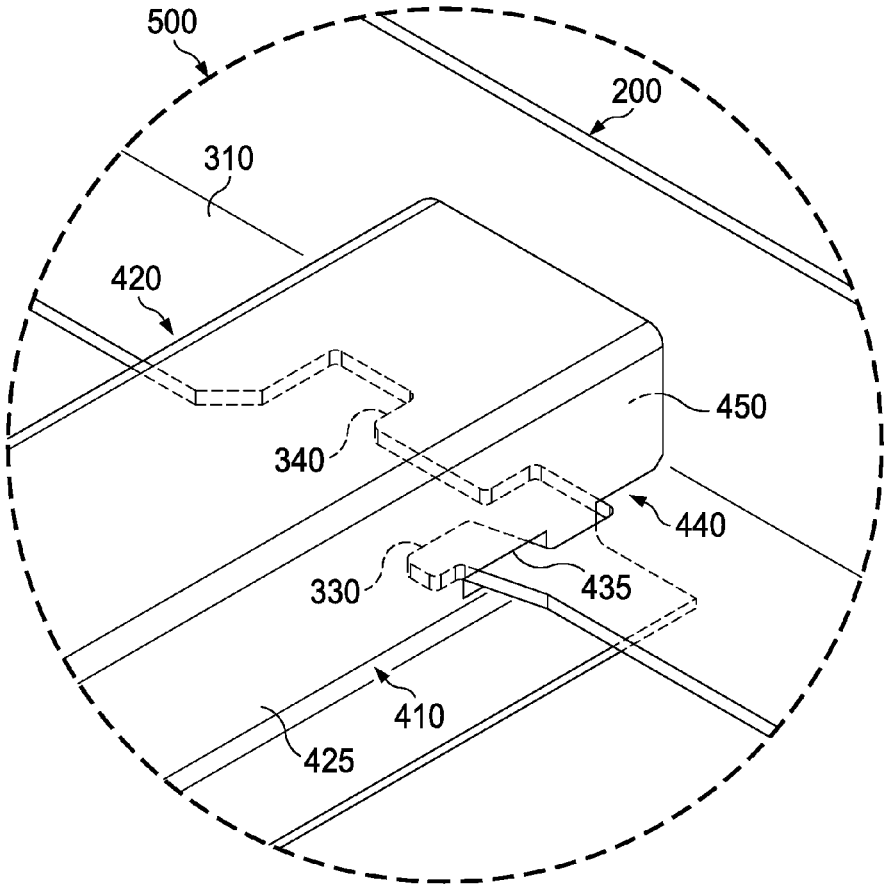
FIG. 6 is a closer view of the embodiments shown in FIG. 5.

FIG. 6 illustrates a closer view of the circled section 500 in FIG. 5. Locking tab 330 of the lip 310 of the shelf bracket 200 is removably received in the channel 450 through the tab slot 435 and the optional second tab 340 is removably received in the channel 450. A side of the end of the locking tab 330 and a side of the optional second tab 340 abut the inner walls of the rail side 425 of the first and second rails 410, 420, respectively. This locking profile prevents the shelf bracket's 200 rotational and lateral movements along the length L of the shelf 250 sufficiently that they do not disengage from the rails 410, 420. Also, the shelf bracket 250 is laterally movable about ⅛ inches within its respective tab slot 430 so that they may tolerate deviations of the attachment apertures 112 in the vertical back wall 110 of a display case 100 up to ¼ inches. It is understood that conventional, permanently assembled shelf assemblies are brittle and do not tolerate any deviation, being prone to cracks and breakage between the parts.

To assemble the shelf assembly 150, the optional second tab 340 of the lip 310 of the shelf bracket 200 is partially received in the channel 450 between the first and second rails 410, 420 such that the end of the locking tab 330 lines up with the tab slot 435. Then, the end of the locking tab 330 is pushed down along the direction of the length L into the tab slot 435 and pushed aside along the direction of the width W.

To disassemble the shelf assembly 150, the shelf bracket 200 is pulled aside partially, along the direction of the width W, to the side so that the end of the locking tab 330 can come out of the channel 450 through the tab slot 435. After pulling the end of the locking tab 330 out of the tab slot 435, the shelf bracket 200 is partially flipped away from the bottom surface of the shelf 250, disengaging the shelf bracket 200 from the shelf 250.

From the foregoing, a 3-part shelf assembly that can be assembled without using fastening devices, welding or structural tapes are provided. Moreover, the provided assembly does not require the fourth and fifth additional parts that are conventionally used in facilitating and reinforcing the connections between the shelf and the shelf bracket. Due to the absence of those additional parts, the provided assembly requires less material, achieving reduced warranty costs and manufacturing costs. Furthermore, even in the absence of those additional parts, the provided assembly achieves an improved loading capacity, approximately twice that of the conventional assembly.

Moreover because the provided shelf assembly does not require any fastening devices, welding or structural tapes, it can be assembled and disassembled more quickly and easily and allows each individual part of the assembly to be replaceable. This allows improved serviceability and longer life for the assembly. Also the provided shelf assembly allows slight movements between the parts, compensating slight design tolerances in parts and in a display case.

Those skilled in the art to which this application relates will appreciate that other and further additions, deletions, substitutions and modifications may be made to the described embodiments and that the described embodiments may be manufactured using sheet metal processing.

What is claimed is:

1. A shelf assembly for a display case, comprising:

a shelf having top and bottom surfaces, said shelf including at least one support rail secured to the bottom surface of said shelf, said at least one support rail runs parallel to one side of said shelf and has a tab slot located in a side, adjacent to an end thereof; and a shelf bracket having a horizontal lip and a skirt that extends perpendicular from said lip, said lip and said skirt extending along a length of said shelf bracket, said shelf bracket having a first tab located in said lip and configured to be removably received in said tab slot, said shelf bracket having anchoring tabs located on an end thereof and configured to be received in a shelving support frame.

2. The shelf assembly of claim 1, wherein said support rail comprises parallel first and second spaced apart rails that extend across said bottom surface of said shelf, wherein at least one of said first or second rails having said tab slot located in a side thereof.

3. The shelf assembly of claim 1, wherein said support rail is a hat rail having a channel therein.

4. The shelf assembly of claim 3, wherein said shelf bracket further includes a second tab located in said lip and adjacent said first tab, said second tab configured to be received in said channel and said first tab is configured to be located within said channel when received in said slot.

5. The shelf assembly of claim 4, wherein said support rail is a first support rail and said shelf assembly further includes a second support rail located on said bottom surface of said shelf and spaced apart from said first support rail, wherein said first and second tabs forms a first locking profile that engages said slot and said channel of said first support rail and said shelf bracket further includes a second locking profile in said lip that engages a slot and a channel of said second support rail.

6. The shelf assembly of claim 1, wherein said support rail is a first support rail and said shelf assembly further includes a second support rail located on said bottom surface of said shelf and spaced apart from said first support rail, wherein said first tab forms a first locking profile that engages said slot of said first support rail and said shelf bracket further includes a second locking profile in said lip that engages a slot of said second support rail.

7. The shelf assembly of claim 6, wherein said first and second locking profiles are formed such that portions of said lip overlap portions of said first and second support rails and provide support to said shelf assembly.

8. A shelf bracket and a support rail, comprising:

at least one support rail with a tab slot positioned in a side and adjacent to an end thereof, the at least one support rail configured to be attached to a bottom surface of a shelf;

a shelf bracket with a horizontal lip and a skirt that extends perpendicular from said lip, said lip and said skirt extending along a length of said shelf bracket, said shelf bracket having a first tab located in said lip and configured to be removably received in the tab slot; and anchoring tabs located on an end of said shelf bracket and configured to be received in a shelving support frame.

9. The shelf bracket of claim 8, wherein said at least one support rail comprises parallel first and second spaced apart rails that extend across said bottom surface of said shelf, wherein at least one of said first or second rails having said tab slot located in a side thereof.

10. The shelf bracket of claim 8, wherein said at least one support rail is a hat rail having a channel therein.

11. The shelf bracket of claim 10, wherein said lip includes a second tab located therein and adjacent said first tab, said second tab configured to be received in said channel and said first tab is configured to be located within said channel when received in said slot.

12. The shelf bracket of claim 11, wherein said support rail is a first support rail and a second support rail is located on said bottom surface of said shelf and spaced apart from said first support rail, wherein said first and second tabs forms a first locking profile that engages said slot and said channel of said first support rail and said shelf bracket further includes a second locking profile in said lip that engages a slot and a channel of said second support rail.

13. The shelf bracket of claim 8, wherein said at least one support rail is a first support rail and a second support rail is located on said bottom surface of said shelf and spaced apart from said first support rail, wherein said first tab forms a first locking profile that engages said slot of said first support rail and said shelf bracket further includes a second locking profile in said lip that engages a slot of said second support rail.

14. A shelf comprising:

a top surface and a bottom surface;

a shelf bracket comprising a horizontal lip, a skirt, and a first tab located in the lip; and at least one support rail secured to the bottom surface of said shelf and runs parallel to one side of said shelf, said support rail having a tab slot located in a side and adjacent to an end thereof, said tab slot is configured to removably receive the first tab of the shelf bracket, said lip and the skirt of said shelf bracket extends along a length of said shelf bracket and said shelf bracket having anchoring tabs located on an end thereof and configured to be received in a shelving support frame.

15. The shelf of claim 14 wherein said support rail comprises parallel first and second spaced apart rails that extend across said bottom surface of said shelf, wherein at least one of said first or second rails having said tab slot located in a side thereof.

16. The shelf of claim 14, wherein said support rail is a hat rail having a channel therein.

17. The shelf of claim 16, wherein said shelf bracket further includes a second tab located in said lip and adjacent said first tab, said second tab configured to be received in said channel and said first tab is configured to be located within said channel when received in said slot.

18. The shelf of claim 17, wherein said support rail is a first support rail and said shelf further includes a second support rail located on said bottom surface of said shelf and spaced apart from said first support rail, wherein said first and second tabs forms a first locking profile that engages said slot and said channel of said first support rail and said shelf bracket further includes a second locking profile in said lip that engages a slot and a channel of said second support rail.

19. The shelf of claim 14, wherein said support rail is a first support rail and said shelf further includes a second support rail located on said bottom surface of said shelf and spaced apart from said first support rail, wherein said first tab forms a first locking profile that engages said slot of said first support rail and said shelf bracket further includes a second locking profile in said lip that engages a slot of said second support rail.

20. The shelf of claim 19, wherein said first and second locking profiles are formed such that portions of said lip overlap portions of said first and second support rails and provide support to said shelf.

* * * * *